US009664191B2

(12) United States Patent
Tanaka

(10) Patent No.: US 9,664,191 B2
(45) Date of Patent: May 30, 2017

(54) ROTARY COMPRESSOR WITH INCREASED HEATING ABILITY AND REFRIGERANT CIRCUIT FOR AN AIR CONDITIONER

(71) Applicant: FUJITSU GENERAL LIMTED, Kawasaki-shi, Kanagawa-ken (JP)

(72) Inventor: Junya Tanaka, Kawasaki (JP)

(73) Assignee: FUJITSU GENERAL LIMITED, Kawasaki-Shi, Kanagawa (JP)

( * ) Notice: Subject to any disclaimer, the term of this patent is extended or adjusted under 35 U.S.C. 154(b) by 89 days.

(21) Appl. No.: 14/669,774

(22) Filed: Mar. 26, 2015

(65) Prior Publication Data

US 2015/0275895 A1 Oct. 1, 2015

(30) Foreign Application Priority Data

Mar. 28, 2014 (JP) ..... 2014-067535

(51) Int. Cl.
*F03C 2/00* (2006.01)
*F03C 4/00* (2006.01)
(Continued)

(52) U.S. Cl.
CPC ..... *F04C 18/34* (2013.01); *F04C 23/008* (2013.01); *F04C 29/0085* (2013.01);
(Continued)

(58) Field of Classification Search
CPC .... F04C 18/34; F04C 18/356; F04C 18/3564; F04C 29/0007; F04C 29/0085;
(Continued)

(56) References Cited

U.S. PATENT DOCUMENTS 3,167,930 A * 2/1965 Rasovich ..... F25B 43/006 62/503
4,215,555 A * 8/1980 Cann ..... F25B 43/006 62/503
(Continued)

FOREIGN PATENT DOCUMENTS

JP 57129286 A * 8/1982 ..... F04C 23/008
JP 11037578 A * 2/1999 ..... F04C 23/008
(Continued)

*Primary Examiner* — Theresa Trieu
(74) *Attorney, Agent, or Firm* — Manabu Kanesaka

(57) ABSTRACT

A rotary compressor includes: a compressor body including an airtight container that has a refrigerant intake opening and a refrigerant discharge opening, a refrigerant compression unit that has a cylinder and a rotary piston housed in the cylinder and that is provided in the airtight container, and an electric motor that drives the rotary piston and is provided in the airtight container; and an accumulator configured to separate a refrigerant suctioned into the refrigerant intake opening into gas and liquid. The accumulator and the refrigerant intake opening are connected via a refrigerant intake pipe, a suction opening of the refrigerant intake pipe is arranged to be opened to the inside of the accumulator, an injection pipe for pouring the refrigerant into the rotary compressor is inserted into the accumulator from above, and a discharge opening of the injection pipe is drawn to face the suction opening of the refrigerant intake pipe in a refrigerant gas space of the accumulator.

11 Claims, 4 Drawing Sheets

(51) Int. Cl.

| | |
|---|---|
| ***F04C 2/00*** | (2006.01) |
| ***F04C 11/00*** | (2006.01) |
| ***F04C 18/34*** | (2006.01) |
| ***F25B 39/04*** | (2006.01) |
| ***F25B 43/00*** | (2006.01) |
| ***F25B 39/02*** | (2006.01) |
| ***F25B 39/00*** | (2006.01) |
| ***F25B 43/02*** | (2006.01) |
| ***F04C 23/00*** | (2006.01) |
| ***F04C 29/04*** | (2006.01) |
| ***F04C 29/00*** | (2006.01) |
| ***F04C 29/12*** | (2006.01) |
| *F04C 18/356* | (2006.01) |

(52) U.S. Cl.
CPC ..... *F04C 29/042* (2013.01); *F04C 29/12* (2013.01); *F25B 39/00* (2013.01); *F25B 39/02* (2013.01); *F25B 39/04* (2013.01); *F25B 43/006* (2013.01); *F25B 43/02* (2013.01); *F04C 18/356* (2013.01); *F04C 2240/804* (2013.01); *F04C 2240/806* (2013.01)

(58) Field of Classification Search
CPC .... F04C 29/0092; F04C 29/02; F04C 29/026; F04C 29/042; F04C 29/12; F04C 23/008; F04C 23/001; F04C 2240/804; F04C 2240/806; F04C 2240/809; Y10S 418/01; F25B 39/00; F25B 39/02; F25B 39/04; F25B 2240/075; F25B 43/006; F25B 43/02; F25B 43/043; F25B 13/00
USPC ..... 418/11, 15, 46–47, 60, 63, 270, DIG. 1; 62/324.1, 498, 503, 506, 508
See application file for complete search history.

(56) References Cited

U.S. PATENT DOCUMENTS

| | | | | | |
|---|---|---|---|---|---|
| 4,475,360 | A * | 10/1984 | Suefuji | ..... | F25B 13/00 62/324.1 |
| 6,569,347 | B1 * | 5/2003 | Nomura | ..... | F25B 31/002 62/468 |
| 7,641,454 | B2 * | 1/2010 | Ueda | ..... | F04C 23/008 418/60 |

FOREIGN PATENT DOCUMENTS

| | | | | | |
|---|---|---|---|---|---|
| JP | 2000337261 | A * | 12/2000 | ..... | F04C 23/008 |
| JP | 2001330343 | A * | 11/2001 | ..... | F04C 23/008 |
| JP | 2013-245837 | A | 12/2013 | | |
| KR | 20040107722 | A * | 12/2004 | ..... | F04C 23/008 |

* cited by examiner

ROTARY COMPRESSOR WITH INCREASED HEATING ABILITY AND REFRIGERANT CIRCUIT FOR AN AIR CONDITIONER

CROSS-REFERENCE TO RELATED APPLICATION

This application claims priority from Japanese Patent Application No. 2014-067535 filed with the Japan Patent Office on Mar. 28, 2014, the entire content of which is hereby incorporated by reference.

BACKGROUND

1. Technical Field

The present invention relates to a rotary compressor provided in a refrigeration cycle apparatus. More specifically, the present invention relates to a technique for lowering a discharge temperature by injecting a refrigerant into a refrigerant compression unit during a heating operation in low ambient air temperature.

2. Description of the Related Art

A rotary compressor includes a refrigerant compression unit as a basic configuration. In this refrigerant compression unit, a rotary piston (a rotor) driven by an electric motor is housed in a cylinder. A single rotor type having one refrigerant compression unit and a twin rotor type having two refrigerant compression units are available as regular models of the rotary compressor.

In recent years, there has been an increasing demand that a refrigeration cycle apparatus that uses a refrigerant, such as an HFC refrigerant such as R32, an HFO refrigerant, or a $CO_2$ refrigerant, be used as a heater especially in cold regions at a low ambient air temperature. Meanwhile, the refrigeration cycle apparatus is operated under an operating condition of a high compression ratio or low suction pressure in a use environment at the low ambient air temperature. Accordingly, the refrigeration cycle apparatus is frequently used in a range of a high discharge temperature. In addition, since the suction pressure is low at the low ambient air temperature, a problem that a heating capacity tends to be insufficient due to a reduced refrigerant circulation amount arises.

As a measure against such a problem, there has been known a technique for lowering a discharge temperature of a refrigerant by injecting a liquid refrigerant into a compression chamber (an actuation chamber) of a cylinder. According to this technique, an amount of the injection refrigerant is added to a normal refrigerant suction amount by injecting the liquid refrigerant into the compression chamber of the cylinder. The refrigerant circulation amount in a condenser is increased by the amount of the injection refrigerant, and thus the heating capacity can be improved.

However, according to the above conventional technique, an injection hole needs to be provided in the cylinder (the compression chamber). Furthermore, an injection pipe needs to be drawn into an airtight container of the compressor and connected to the injection hole. Accordingly, problems of a complex structure and requiring time and effort for processing are inherent to this conventional technique.

In addition, when the injection is off, a portion that corresponds to the injection hole produces so-called dead volume. For this reason, another problem that compression efficiency is degraded during the injection-off period also arises. Furthermore, such a problem that a partitioning plate of the cylinder is too thin for the injection pipe to be connected thereto is inherent to a small model.

In view of the above, according to a technique suggested in JP-A-2013-245837 (see paragraph [0043] and FIG. 1), an injection pipe is connected to an L-shaped pipe portion in which a refrigerant intake pipe that extends from an accumulator to a refrigerant compression unit of a compressor is exposed. A liquid refrigerant is poured into the refrigerant compression unit via the refrigerant intake pipe.

According to this technique, there is no need to provide the injection hole in the cylinder (the compression chamber). Thus, even when the injection is off, the compression efficiency is less likely to be degraded. The injection pipe only needs to be connected to the refrigerant intake pipe, and thus the processing can easily be carried out. In addition, the injection pipe can be connected to a small compressor with a thin partitioning plate.

However, the liquid refrigerant is injected before compression is initiated (when in a state where a gaseous refrigerant from an evaporator side is suctioned into the compression chamber, that is, a state where the compression chamber is communicated with the accumulator). Thus, there is caused a problem that the heating capacity tends to be insufficient because an effect of increasing the refrigerant circulating amount cannot be obtained significantly.

SUMMARY

A rotary compressor includes: a compressor body including an airtight container that has a refrigerant intake opening and a refrigerant discharge opening, a refrigerant compression unit that has a cylinder and a rotary piston housed in the cylinder and that is provided in the airtight container, and an electric motor that drives the rotary piston and is provided in the airtight container; and an accumulator configured to separate a refrigerant suctioned into the refrigerant intake opening into gas and liquid. The accumulator and the refrigerant intake opening are connected via a refrigerant intake pipe, a suction opening of the refrigerant intake pipe is arranged to be opened to the inside of the accumulator, an injection pipe for pouring the refrigerant into the rotary compressor is inserted into the accumulator from above, and a discharge opening of the injection pipe is drawn to face the suction opening of the refrigerant intake pipe in a refrigerant gas space of the accumulator.

DESCRIPTION OF THE EMBODIMENTS

Figure 1:
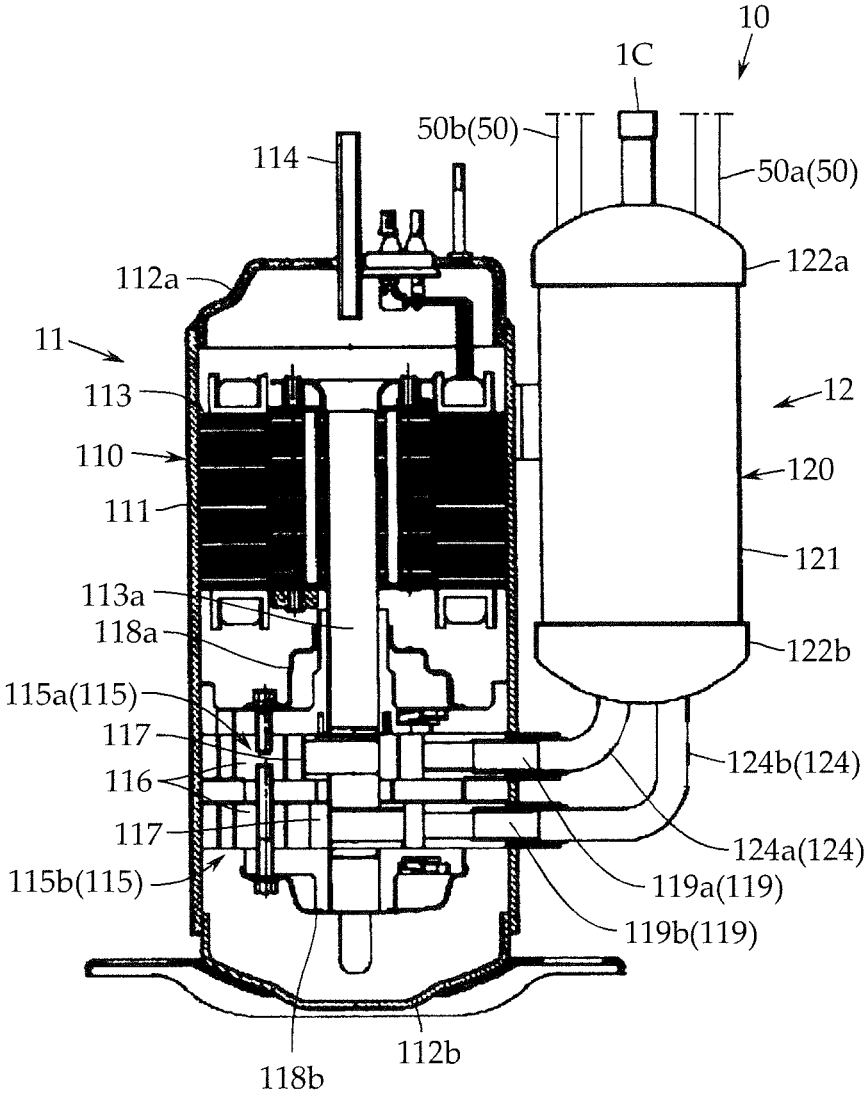
FIG. 1 is a front view partially illustrating a rotary compressor according to an embodiment of the present invention in cross section.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An object of the present invention is to improve a heating capacity by increasing a flow rate of a refrigerant that is suctioned into a compressor during a heating operation at a low ambient air temperature while adopting a method for supplying an injection refrigerant to the compressor via a refrigerant intake pipe.

To achieve the above-described object, a rotary compressor according to an aspect of the present invention includes: a compressor body including an airtight container that has a refrigerant intake opening and a refrigerant discharge opening, a refrigerant compression unit that has a cylinder and a rotary piston housed in the cylinder and that is provided in the airtight container, and an electric motor that drives the rotary piston and is provided in the airtight container; and an accumulator configured to separate a refrigerant suctioned into the refrigerant intake opening into gas and liquid. The accumulator and the refrigerant intake opening are connected via a refrigerant intake pipe, a suction opening of the refrigerant intake pipe is arranged to be opened to the inside of the accumulator, an injection pipe for pouring the refrigerant into the rotary compressor is inserted into the accumulator from above, and a discharge opening of the injection pipe is drawn to face the suction opening of the refrigerant intake pipe in a refrigerant gas space of the accumulator.

According to the aspect of the present invention, in order to avoid or suppress the entry of foreign substances into a gas-liquid separation chamber, it is preferred that a filter and a gas-liquid separation plate are arranged in the accumulator such that the filter is positioned on an upper side, and the injection pipe penetrates the filter and the gas-liquid separation plate and extends to the inside of the refrigerant gas space, and a penetrated portion is sealed by sealing means.

The sealing means preferably includes a first sealing member that is formed in an annular shape toward the filter around a through hole of the gas-liquid separation plate, a cylindrical second sealing member that is fitted to an inside of the first sealing member with a clearance narrower than a thickness of the filter and that is fixed to a side of the injection pipe, and a peripheral edge portion of a through hole of the filter that is interposed between the first sealing member and the second sealing member. The second sealing member may be pressed into the first sealing member along with the peripheral edge portion of the through hole of the filter.

According to a preferred aspect of the present invention, the injection pipe includes a first throttle portion with a reduced diameter at a pipe end on the discharge opening side. In addition, the refrigerant intake pipe includes a second throttle portion with a reduced diameter in a portion adjacent to the suction opening. Furthermore, the injection pipe preferably enters the inside of the second throttle portion of the refrigerant intake pipe.

According to the present invention, the injection pipe is drawn from an upper portion of the accumulator and faces the suction opening of the refrigerant intake pipe in the refrigerant gas space. Preferably, a throttle portion is formed in the injection pipe and/or the refrigerant intake pipe. Accordingly, static pressure around the throttle portion is lowered by high-speed injection of a refrigerant flow from the injection pipe. Thus, the flow rate of the refrigerant supplied to the compressor is increased by an ejector effect that a gaseous refrigerant in the accumulator is suctioned into the refrigerant intake pipe, and the heating capacity is improved by the increase.

Next, an embodiment of the present invention will be described with reference to FIGS. 1 to 6. However, the present invention is not limited thereto.

Referring to FIG. 1, a rotary compressor 10 according to this embodiment includes a compressor body 11 and an accumulator 12 attached to the compressor body 11 as a basic configuration. The rotary compressor 10 is incorporated in a refrigerant circuit RC illustrated in FIGS. 2A and B.

The compressor body 11 includes an airtight container 110. The airtight container 110 has a cylindrical container body 111, and an upper lid 112*a* and a lower lid 112*b* that cover the container body 111. A refrigerant compression unit 115 and an electric motor 113 are housed in the airtight container 110.

In this embodiment, the refrigerant compression unit 115 includes a first refrigerant compression unit 115*a* and a second refrigerant compression unit 115*b* that are two refrigerant compression units vertically arranged in two stages. Each of the first refrigerant compression unit 115*a* and the second refrigerant compression unit 115*b* includes a cylinder 116 and a rotary piston 117 as a rotor that is housed in the cylinder 116.

The rotary piston 117 on the first refrigerant compression unit 115*a* side and the rotary piston 117 on the second refrigerant compression unit 115*b* side are eccentrically fixed to a rotary drive shaft 113*a* of the electric motor 113 and rotatably driven with a phase of 180°.

A refrigerant is suctioned into the first refrigerant compression unit 115*a* and the second refrigerant compression unit 115*b* from refrigerant intake openings 119*a* and 119*b* that are provided in a lower portion of the container body 111. A compressed refrigerant generated by the first refrigerant compression unit 115*a* is discharged into the airtight container 110 via an upper muffler 118*a*. In addition, a compressed refrigerant generated by the second refrigerant compression unit 115*b* is discharged into the airtight container 110 via a lower muffler 118*b*. Each compressed refrigerant is supplied to the refrigerant circuit RC from a refrigerant discharge pipe 114 that is provided in the upper lid 112*a*.

It should be noted that, in the case where there is no need to distinguish the first refrigerant compression unit 115*a* from the second refrigerant compression unit 115*b*, these are collectively referred to as the refrigerant compression unit 115. Similarly, in the case where there is no need to distinguish the refrigerant intake openings 119*a* from the refrigerant intake openings 119*b*, these are collectively referred to as a refrigerant intake opening 119.

The accumulator 12 includes an airtight container 120. Similar to the above-described airtight container 110, the airtight container 120 includes a cylindrical container body 121, and an upper lid 122*a* and a lower lid 122*b* that cover the container body 121. This airtight container 120 is arranged with an axis thereof being substantially perpendicular, that is, placed vertically, and is attached to a side of the compressor body 11 via fastening and fixing means such as a band, for example.

A refrigerant return pipe 1C of the refrigerant circuit RC, which will be described below, and an injection pipe 50 (50*a*, 50*b*) are drawn into the accumulator 12 from the upper lid 122*a*. In addition, a refrigerant intake pipe 124 (124*a*, 124*b*) that is connected to each cylinder 116 in the refrigerant compression unit 115 (115*a*, 115*b*) is drawn from the lower lid 112*b*.

It should be noted that, in this embodiment, two refrigerant compression units 115*a* and 115*b* are provided as the refrigerant compression unit 115, and each of them is actuated independently. Accordingly, the two refrigerant intake pipes 124*a* and 124*b* are used to respectively correspond to the refrigerant compression units 115*a* and 115*b*. In the case of two-stage compression, or in the case where one refrigerant compression unit 115 is provided, one refrigerant intake pipe 124 to be drawn is provided. In the case where there is no need to distinguish the two refrigerant intake pipes 124*a* and 124*b* from each other, these are collectively referred to as the refrigerant intake pipe 124.

Here, the refrigerant circuit RC will be described with reference to FIG. 2A. This refrigerant circuit RC is a circuit for an air conditioner of heat pump type that includes an outdoor unit 1 and an indoor unit 2. In this refrigerant circuit RC, the outdoor unit 1 and the indoor unit 2 are connected by a liquid-side refrigerant pipe 1A and a gas-side refrigerant pipe 1B.

Figure 2A:
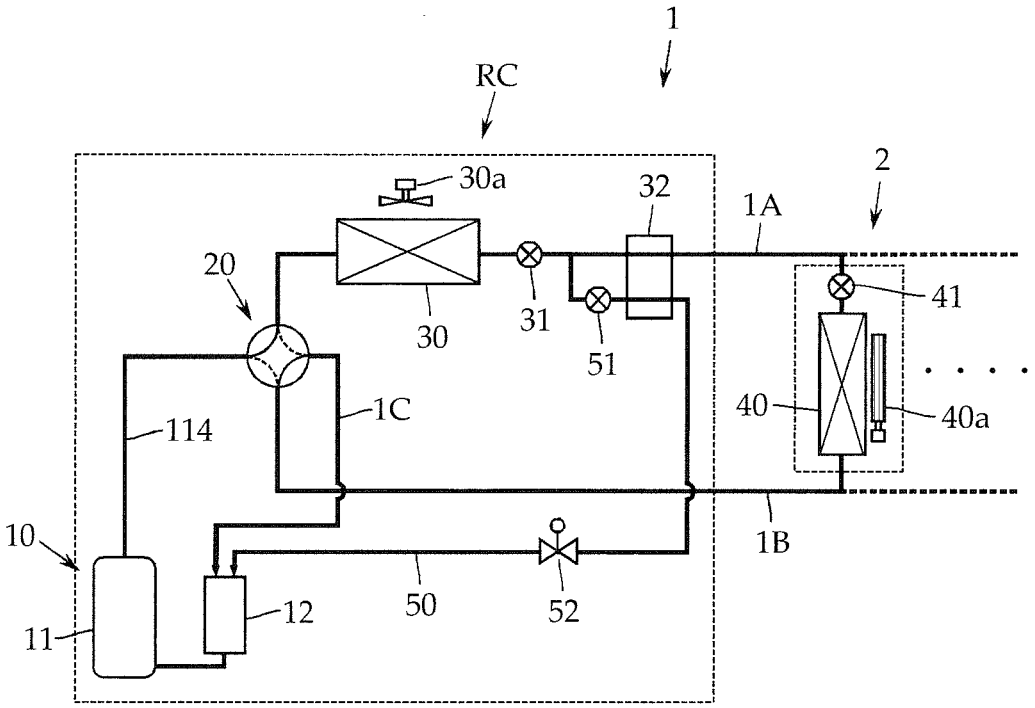
FIG. 2A is a schematic view illustrating one example of a refrigeration cycle including the rotary compressor.

In an example illustrated in FIG. 2A, one indoor unit 2 is provided. Alternatively, plural indoor units 2 may be connected in parallel between the liquid-side refrigerant pipe 1A and the gas-side refrigerant pipe 1B.

The outdoor unit 1 is provided with the rotary compressor 10 having the above configuration, a four-way valve 20, an outdoor heat exchanger 30, an outdoor blowing fan 30*a*, an outdoor expansion valve 31, and the injection pipe 50. The indoor unit 2 is provided with an indoor heat exchanger 40, an indoor blowing fan 40*a*, and an indoor expansion valve 41.

During a heating operation, as a basic operation, the four-way valve 20 is switched as illustrated by chain lines in FIG. 2A. The outdoor expansion valve 31 and the indoor expansion valve 41 are adjusted at specified opening degrees by a controller, which is not illustrated.

A gaseous refrigerant at a high temperature and high pressure that is generated in the compressor body 11 and discharged from the refrigerant discharge pipe 114 is delivered to the indoor heat exchanger 40 via the four-way valve 20 and the gas-side refrigerant pipe 1B. This gaseous refrigerant at the high temperature and the high pressure is cooled through heat exchange with indoor air, and is decompressed at the indoor expansion valve 41. Then, the refrigerant is returned to the outdoor unit 1 side via the liquid-side refrigerant pipe 1A, and is decompressed at the outdoor expansion valve 31. In this way, the refrigerant turns into a gas-liquid two-phase refrigerant at low pressure. This gas-liquid two-phase refrigerant is heated and evaporated through heat exchange with outdoor air in the outdoor heat exchanger 30 and turns into a low-pressure refrigerant. This low-pressure refrigerant enters the accumulator 12 from the refrigerant return pipe 1C through the four-way valve 20 and undergoes gas-liquid separation. The gaseous refrigerant after the gas-liquid separation is supplied to the refrigerant compression unit 115 via the refrigerant intake pipe 124. As described above, during the heating operation, the indoor heat exchanger 40 acts as a condenser, and the outdoor heat exchanger 30 acts as an evaporator.

During a cooling operation, as a basic operation, the four-way valve 20 is switched as illustrated by solid lines in FIG. 2A. The outdoor expansion valve 31 is fully opened, and the indoor expansion valve 41 is adjusted at a specified opening degree by the controller, which is not illustrated.

The gaseous refrigerant at a high temperature and high pressure that is generated in the compressor body 11 and discharged from the refrigerant discharge pipe 114 is delivered to the outdoor heat exchanger 30 via the four-way valve 20. This gaseous refrigerant at the high temperature and the high pressure is cooled through heat exchange with outdoor air and turns into a liquefied refrigerant at high pressure. This liquefied refrigerant reaches the indoor unit 2 via the liquid-side refrigerant pipe 1A, and is decompressed at the indoor expansion valve 41. In this way, the refrigerant turns into a gas-liquid two-phase refrigerant. This gas-liquid two-phase refrigerant is evaporated through heat exchange with indoor air in the indoor heat exchanger 40 and turns into a gaseous refrigerant at low pressure. This gaseous refrigerant is returned to the outdoor unit 1 side via the gas-side refrigerant pipe 1B, enters the accumulator 12 from the refrigerant return pipe 1C through the four-way valve 20, and undergoes gas-liquid separation. The gaseous refrigerant after the gas-liquid separation is supplied to the refrigerant compression unit 115 via the refrigerant intake pipe 124. As described above, during the cooling operation, the indoor heat exchanger 40 acts as an evaporator, and the outdoor heat exchanger 30 acts as a condenser.

In the refrigerant circuit RC of FIG. 2A, the injection pipe 50 is branched from the liquid-side refrigerant pipe 1A at a position of the liquid-side refrigerant pipe 1A that is on an upstream side of the outdoor expansion valve 31 during the heating operation and on a downstream side the outdoor expansion valve 31 during the cooling operation. The injection pipe 50 runs through a double-pipe heat exchanger 32 for injection in which heat exchange between the refrigerant in the injection pipe 50 and the refrigerant in the liquid-side refrigerant pipe 1A is carried out, and reaches the accumulator 12. The injection pipe 50 is provided with a solenoid valve 51 for injection, an opening degree of which can be adjusted, and a switching valve 52 for an injection refrigerant.

Figure 2B:
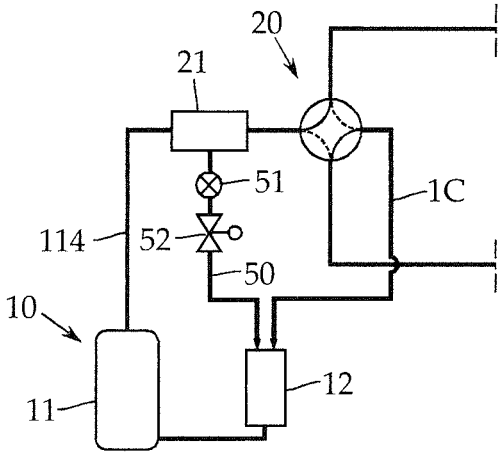
FIG. 2B is a schematic view illustrating a pipe portion of an injection pipe in another example of the refrigeration cycle.

As illustrated in FIG. 2B, the injection pipe 50 may be drawn from a gas-liquid separator 21 that is provided in the refrigerant discharge pipe 114 arranged between the compressor body 11 and the four-way valve 20.

Figure 3:
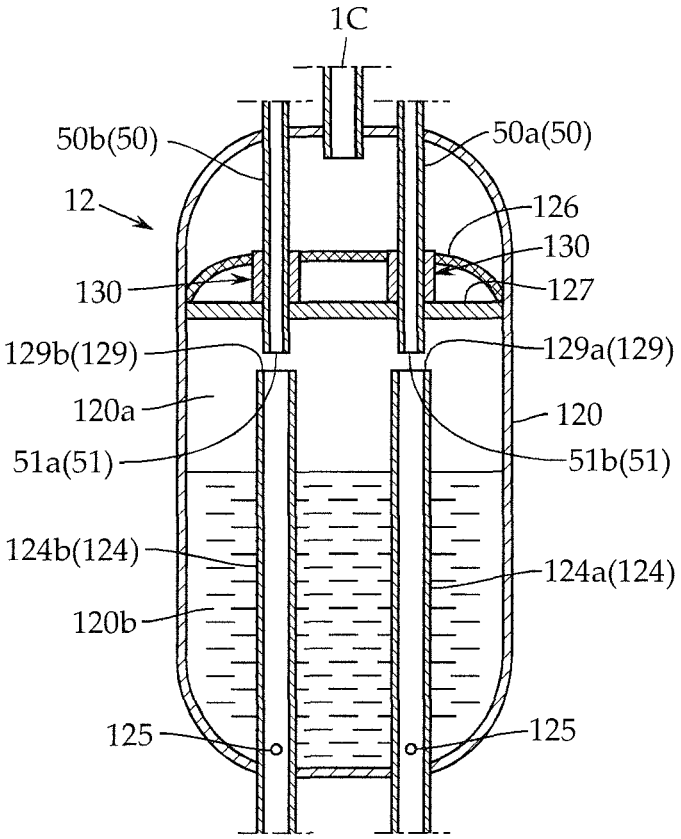
FIG. 3 is a schematic view illustrating an internal structure of an accumulator provided in the rotary compressor.

Referring to FIG. 3, the accumulator 12 is provided with a filter 126 and a gas-liquid separation plate 127. The filter 126 is formed of a wire net or the like, for example, and removes foreign substances contained in the refrigerant. In regard to a positional relationship of them, the filter 126 is arranged on an upper side, and the gas-liquid separation plate 127 is arranged on a lower side thereof.

The refrigerant supplied from the refrigerant return pipe 1C undergoes the gas-liquid separation in the gas-liquid separation plate 127. A liquid refrigerant is reserved in a state of containing refrigerator oil in a lower section of the accumulator 12. The gaseous refrigerant is reserved in an upper section thereof. A portion in which the liquid refrigerant is reserved is referred to as a liquid refrigerant reservoir 120*b*, and a portion in which the gaseous refrigerant is reserved is referred to as a refrigerant gas space 120*a* as a matter of convenience.

In the accumulator 12, the refrigerant intake pipes 124*a* and 124*b* penetrate the lower lid 122*b*, are erected substantially perpendicularly, and extend to the refrigerant gas space 120*a*. In the refrigerant gas space 120*a*, respective suction openings 129*a* and 129*b* of the refrigerant intake pipes 124*a* and 124*b* are opened. Refrigerator oil return holes 125 with small diameters are perforated in portions of the refrigerant intake pipes 124*a* and 124*b* that are soaked in the liquid refrigerant reservoir 120*b*. It should be noted that, in the case where there is no need to distinguish the suction openings 129*a* and 129*b* from each other, these are collectively referred to as a suction opening 129.

According to the present invention, the injection pipes 50*a* and 50*b* are drawn from the upper lid 122*a* in the accumulator 12 such that the injection pipes 50*a* and 50*b* penetrate the filter 126 and the gas-liquid separation plate 127 and that discharge openings 51*a* and 51*b* of the injection pipes 50*a* and 50*b* respectively face the suction openings 129*a* and 129*b* of the refrigerant intake pipe 124 in the refrigerant gas space 120*a*.

In this embodiment, two refrigerant intake pipes 124*a* and 124*b* are provided. Thus, corresponding to this, the injection pipe 50 is branched into two at a specified position, which is not illustrated, and has the injection pipes 50*a* and 50*b*. These injection pipes 50*a* and 50*b* are drawn into the accumulator 12. It should be noted that, in the case where there is no need to distinguish the injection pipes 50*a* and 50*b* from each other, these are collectively referred to as the injection pipe 50. Similarly, in the case where there is no need to distinguish the discharge openings 51*a* and 51*b* from each other, these are collectively referred to as a discharge opening 51.

During the heating operation, the pressure of the refrigerant that has undergone the heat exchange with indoor air in the indoor heat exchanger 40 is lowered to a specified pressure at the indoor expansion valve 41. Then, the refrigerant is returned to the outdoor unit 1 side via the liquid-side refrigerant pipe 1A. By turning on (i.e., opening) the switching valve 52, some of the refrigerant in the liquid-side refrigerant pipe 1A flows through the injection pipe 50, is decompressed at the solenoid valve 53 for injection, and passes through the double-pipe heat exchanger 32 for injection. In this way, the heat exchange between the refrigerant in the injection pipe 50 and the refrigerant in the liquid-side refrigerant pipe 1A is carried out. Thereafter, the refrigerant in the injection pipe 50 is injected at high speed from the discharge opening 51 of the injection pipe 50 into the accumulator 12.

The injection refrigerant is injected at high speed from the discharge opening 51 of the injection pipe 50 toward the suction opening 129 of the refrigerant intake pipe 124, as described above. Accordingly, static pressure around the suction opening of the refrigerant intake pipe 124 is lowered. As a result, the gaseous refrigerant in the accumulator 12 is drawn into the refrigerant intake pipe 124.

Due to this ejector effect, a flow rate of the refrigerant suctioned into the refrigerant compression unit 115 is increased. Thus, in particular, a heating capacity during the heating operation at the low ambient air temperature can be ensured. While the injection refrigerant may be a gaseous refrigerant, it is preferably a liquid refrigerant. Since the inside of the compression chamber is cooled by injection of the liquid refrigerant, an increase in a discharge temperature can be suppressed.

Figure 4A:
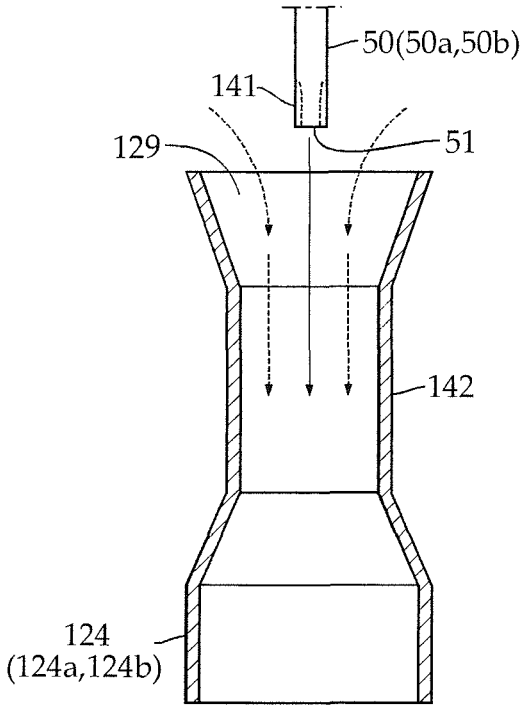
FIG. 4A is a schematic cross-sectional view illustrating a first example of a configuration that exhibits an ejector effect and is a main part of the present invention.
Figure 4B:
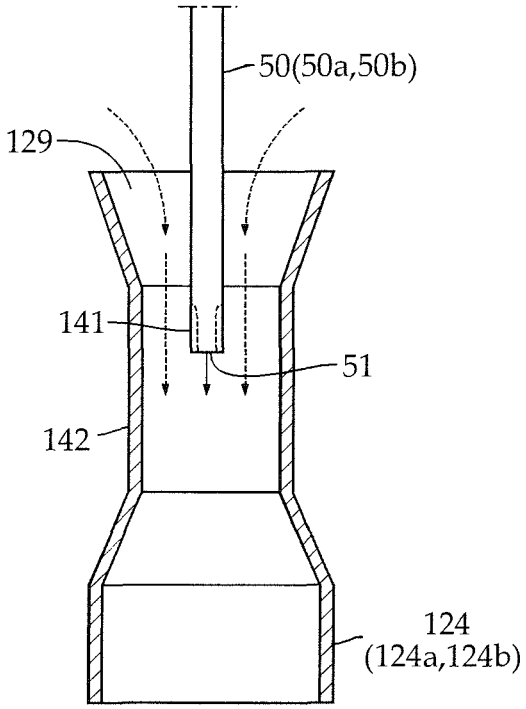
FIG. 4B is a schematic cross-sectional view illustrating a second example thereof.

In regard to arrangement of the discharge opening 51 of the injection pipe 50 and the suction opening 129 of the refrigerant intake pipe 124, as illustrated in FIG. 4A, the discharge opening 51 and the suction opening 129 may face each other with an appropriate distance under a condition that the ejector effect can be obtained. Alternatively, as illustrated in FIG. 4B, a pipe end on the discharge opening 51 side of the injection pipe 50 may be inserted into the refrigerant intake pipe 124.

In either case, in order to enhance the ejector effect, it is preferred to form a throttle portion (a first throttle portion) 141 with a reduced diameter at the pipe end on the discharge opening 51 side of the injection pipe 50 so as to form the pipe end on the discharge opening 51 side in a nozzle shape.

In addition, a throttle portion (a second throttle portion) 142 with a reduced diameter may be provided in a part of the refrigerant intake pipe 124. A flow velocity of the refrigerant is increased in the throttle portion 142, and thus, the static pressure around the suction opening of the refrigerant intake pipe 124 can be further lowered.

It should be noted that, after the refrigerant passes through the throttle portion 142, the flow velocity of the refrigerant is lowered due to an increase in a cross-sectional area of a refrigerant passage. Accordingly, the pressure of the refrigerant is increased. This results in an increase in suction pressure of the refrigerant compression unit 115, which also leads to a reduction in compression power of the electric motor 113.

As described above, the injection pipe 50 penetrates the filter 126 and the gas-liquid separation plate 127 and is drawn into the refrigerant gas space 120*a*. If a clearance is generated in this penetrated portion, foreign substances may enter the reservoir of the accumulator 12.

Figure 5:
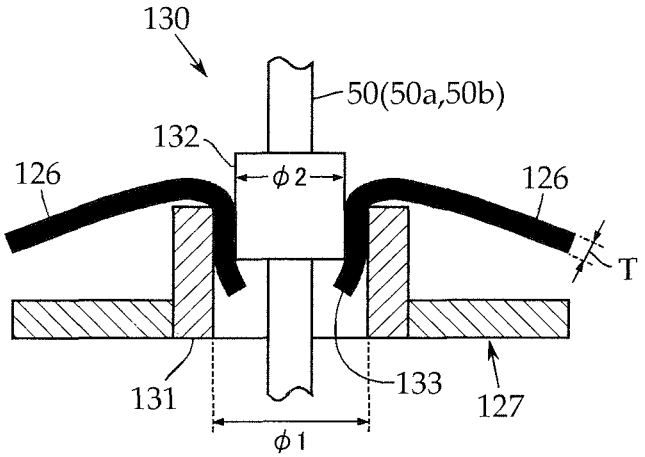
FIG. 5 is a schematic cross-sectional view illustrating a sealing portion of the injection pipe in the accumulator.

In view of the above, in this embodiment, the generation of the clearance in the penetrated portion is avoided or suppressed by sealing means 130 as illustrated in FIG. 5.

This sealing means 130 includes a first sealing member 131, a cylindrical second sealing member 132, and a peripheral edge portion 133 of a through hole of the filter 126. The first sealing member 131 is formed in an annular shape toward the filter 126 side around a through hole of the gas-liquid separation plate 127. The second sealing member 132 is fixed to the injection pipe 50 side. The peripheral edge portion 133 of the through hole of the filter 126 is interposed between the first sealing member 131 and the second sealing member 132.

The first sealing member 131 may be a cylindrical body that is brazed to the gas-liquid separation plate 127 and formed of a copper material, for example. However, in terms of easiness of processing, the first sealing member 131 is preferably an annular raised piece that is integrally formed with the gas-liquid separation plate 127 by burring.

The second sealing member 132 may be a cylindrical body that is brazed to the injection pipe 50 and formed of the copper material, for example. When an inner diameter of the first sealing member 131 is denoted by $\phi 1$, an outer diameter of the second sealing member 132 is denoted by $\phi 2$, and a thickness of the filter is denoted by T, the inner diameter $\phi 1$ of the first sealing member 131 and the outer diameter $\phi 2$ of the second sealing member 132 are defined as $(\phi 1-\phi 2)<T$.

According to this sealing means 130, the second sealing member 132 is pressed into the first sealing member 131 such that the peripheral edge portion 133 of the through hole of the filter 126 is interposed between the first sealing member 131 and the second sealing member 132. Thus, the clearance in the penetrated portion of the injection pipe 50 can be sealed.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A rotary compressor comprising:

a compressor body including an airtight container that has a refrigerant intake opening and a refrigerant discharge opening, a refrigerant compression unit that has a cylinder and a rotary piston housed in the cylinder and that is provided in the airtight container, and an electric motor that drives the rotary piston and is provided in the airtight container; and an accumulator configured to separate a refrigerant suctioned into the refrigerant intake opening into gas and liquid, wherein the accumulator and the refrigerant intake opening are connected via a refrigerant intake pipe, a suction opening of the refrigerant intake pipe is arranged to be opened to an inside of the accumulator, an injection pipe for pouring the refrigerant into the rotary compressor is inserted into the accumulator from above, a discharge opening of the injection pipe is drawn to face the suction opening of the refrigerant intake pipe in a refrigerant gas space of the accumulator, and the discharge opening of the injection pipe enters an inside of the suction opening of the refrigerant intake pipe.

2. The rotary compressor according to claim 1, wherein a filter and a gas-liquid separation plate are arranged in the accumulator such that the filter is positioned on an upper side, and the injection pipe penetrates the filter and the gas-liquid separation plate and extends to an inside of the refrigerant gas space, and a penetrated portion is sealed by sealing unit.

3. The rotary compressor according to claim 2, wherein the sealing unit includes a first sealing member that is formed in an annular shape toward the filter around a through hole of the gas-liquid separation plate, a cylindrical second sealing member that is fitted to an inside of the first sealing member with a clearance narrower than a thickness of the filter and that is fixed to a side of the injection pipe, and a peripheral edge portion of a through hole of the filter that is interposed between the first sealing member and the second sealing member, and the second sealing member is pressed into the first sealing member along with the peripheral edge portion of the through hole of the filter.

4. The rotary compressor according to claim 1, wherein the injection pipe includes a first throttle portion with a reduced diameter at a pipe end on a side of the discharge opening.

5. The rotary compressor according to claim 1, wherein the refrigerant intake pipe includes a second throttle portion with a reduced diameter in a portion adjacent to the suction opening.

6. A refrigerant circuit for an air conditioner of heat pump type comprising an outdoor unit and an indoor unit, the outdoor unit and the indoor unit being connected by a liquid side refrigerant pipe and a gas-side refrigerant pipe, the indoor unit comprising an indoor heat exchanger, and an indoor blowing fan; and the outdoor unit comprising a four-way valve, an outdoor heat exchanger, an outdoor blowing fan, an outdoor expansion valve, and a rotary compressor comprising:

a compressor body including an airtight container that has a refrigerant intake opening and a refrigerant discharge opening, a refrigerant compression unit that has a cylinder and a rotary piston housed in the cylinder and that is provided in the airtight container, and an electric, motor that drives the rotary piston and is provided in the airtight container; and an accumulator configured to separate a refrigerant suctioned into the refrigerant intake opening into gas and liquid, wherein the accumulator and the refrigerant intake opening are connected via a refrigerant intake pipe, a suction opening of the refrigerant intake pipe is arranged to be opened to an inside of the accumulator, an injection pipe that injects the refrigerant to the rotary compressor, together with a refrigerant return pipe are inserted into the accumulator from above, wherein the refrigerant return pipe is configured to return a low-pressure refrigerant to the accumulator via the gas-side refrigerant pipe, and the injection pipe is branched from the liquid-side refrigerant pipe at a position of said liquid-side refrigerant pipe on an upstream side of the outdoor expansion valve during heating operation; and a discharge opening of the injection pipe is drawn to face the suction opening of the refrigerant intake pipe in a refrigerant gas space of the accumulator.

7. The refrigerant circuit according to claim 6, wherein the discharge opening of the injection pipe enters an inside of the suction opening of the refrigerant intake pipe.

8. The refrigerant circuit according to claim 6, wherein a filter and a gas-liquid separation plate are arranged in the accumulator such that the filter is positioned on an upper side, and the injection pipe penetrates the filter and the gas-liquid separation plate and extends to an inside of the refrigerant gas space, and a penetrated portion is sealed by sealing unit.

9. The refrigerant circuit according to claim 8, wherein the sealing unit includes a first sealing member that is formed in an annular shape toward the filter around a through hole of the gas-liquid separation plate, a cylindrical second sealing member that is fitted to an inside of the first sealing member with a clearance narrower than a thickness of the filter and that is fixed to a side of the injection pipe, and a peripheral edge portion of a through hole of the filter that is interposed between the first sealing member and the second sealing member, and the second sealing member is pressed into the first sealing member along with the peripheral edge portion of the through hole of the filter.

10. The refrigerant circuit according to claim 6, wherein the injection pipe includes a first throttle portion with a reduced diameter at a pipe end on a side of the discharge opening.

11. The refrigerant circuit according to claim 6, wherein the refrigerant intake pipe includes a second throttle portion with a reduced diameter in a portion adjacent to the suction opening.

* * * * *